United States Patent [19]

Twitchett

[11] 4,186,421

[45] Jan. 29, 1980

[54] ANTI-STATIC DEVICE

[75] Inventor: Stephen R. Twitchett, Warwick, England

[73] Assignee: Kigass Engineering Ltd., Warwickshire, England

[21] Appl. No.: 909,958

[22] Filed: May 26, 1978

[51] Int. Cl.[2] ..... H01T 19/04

[52] U.S. Cl. ..... 361/212; 361/213; 361/229; 361/235

[58] Field of Search ..... 361/212, 213, 214, 220, 361/221, 222, 225, 229, 230, 231, 235, 232; 363/22, 27, 33; 315/209 CD; 250/324, 325, 326; 128/190

[56] References Cited

U.S. PATENT DOCUMENTS

| | | | |
|---|---|---|---|
| 3,567,996 | 3/1971 | Gordon et al. | 361/235 |
| 3,958,168 | 5/1976 | Grundberg | 315/209 CD |
| 3,983,461 | 9/1976 | Jordan | 315/209 CD |
| 3,997,817 | 12/1976 | Secker | 361/235 X |

*Primary Examiner*—Harry E. Moose, Jr.

*Attorney, Agent, or Firm*—Wender, Murase & White

[57] ABSTRACT

A device for discharging positive or negative static electricity on an article by producing charge of opposite polarity at a sharp tip electrode. The pulse charge is produced by a capacitor triggered at a predetermined voltage to discharge through the primary winding of a transformer to induce a high voltage in the secondary winding which is rectified by a diode to give a pulse charge of the required polarity at the sharp tip electrode. A smoothing capacitor is connected across the output from the diode so that a consistent smoothed or semi-smoothed D.C. potential is obtained when the device is operated continuously. The device may be operated from the A.C. mains or from battery means.

6 Claims, 6 Drawing Figures

ANTI-STATIC DEVICE

SPECIFIC DESCRIPTION

BACKGROUND OF THE INVENTION

This invention relates to anti-static devices such as are used for discharging the positive or negative static electricity produced on a wide range of articles, for example records, fibres, paper, labelling, and such devices can be used in methods employing electro-static effects.

DESCRIPTION OF THE PRIOR ART

It is already known that positive or negative static electricity can be discharged by producing a charge of opposite polarity. Anti-static devices are known in which the required charge is produced by a generator including piezoelectric crystals.

SUMMARY OF THE INVENTION

According to the present invention we provide an anti-static device comprising a casing, power supply means for charging a capacitor, a transformer of which the primary winding is connected to the capacitor and the secondary winding is connected to a discharge electrode, trigger means connected to the capacitor and adapted to trigger the capacitor when the charge stored by the capacitor reaches a predetermined level, and rectifier means connected between the secondary winding of the transformer and the discharge electrode, the arrangement being such that when the capacitor discharges through the primary winding of the transformer a positive or a negative pulse charge is generated at the discharge electrode.

The device can be operated continuously to produce automatically and periodically a series of separate positive or negative pulse charges which ionise the surrounding air.

Preferably the device includes a smoothing capacitor connected across the output from the rectifier means so that when the device is operated continuously a consistent smoothed or semi-smoothed DC potential is produced at the discharge electrode.

Preferably, the trigger means comprises a silicon controlled rectifier (SCR) and firing means for the SCR connected to the gate electrode of the SCR. The firing means may comprise a neon lamp, a relaxation oscillator or a resistance-capacitance trigger circuit.

Normally the SCR is non-conducting as the capacitor is charged. At a predetermined voltage level the firing means produces a pulse at the gate electrode of the SCR which becomes conducting thereby allowing the capacitor to discharge through the primary winding of the transformer to produce the charge at the discharge electrode.

Alternatively the trigger means may comprise a pair of electrodes defining a spark gap.

The power supply means may comprise rectified AC mains voltage or battery means.

The invention will now be described in more detail, by way of example only, with reference to the accompanying drawings.

DESCRIPTION OF THE PREFERRED EMBODIMENTS

Figure 1:
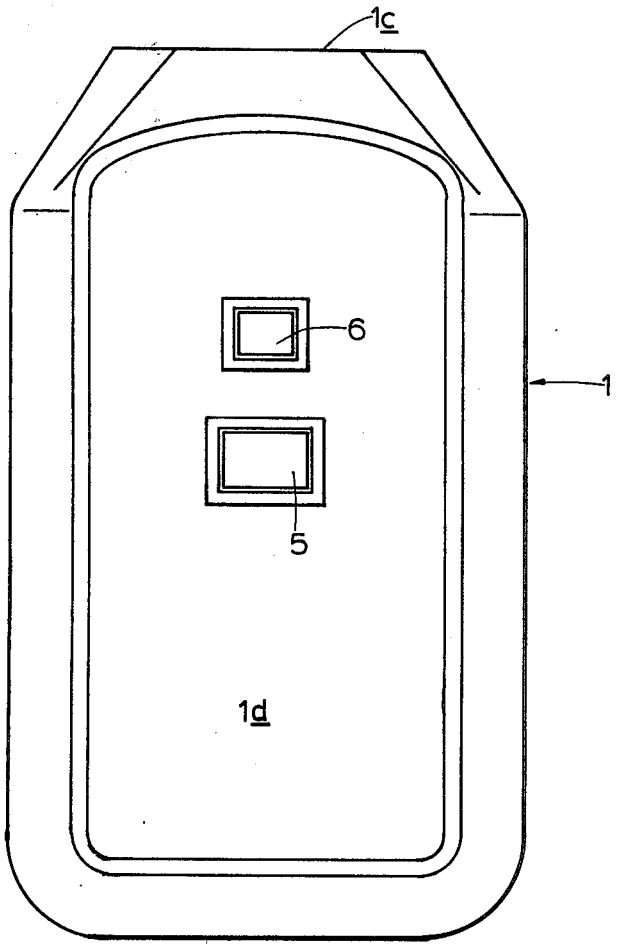
FIG. 1 is a plan view of a device according to the invention.
Figure 2:
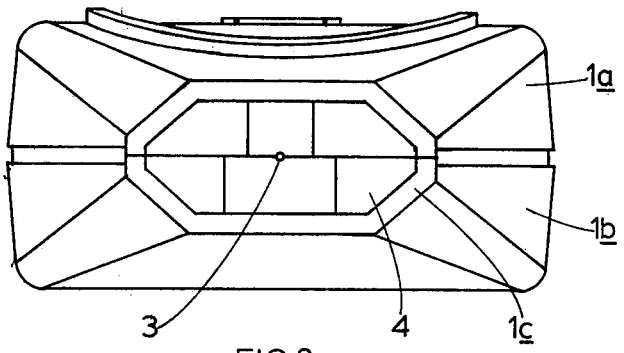
FIG. 2 is a front view of the device shown in FIG. 1.
Figure 3:
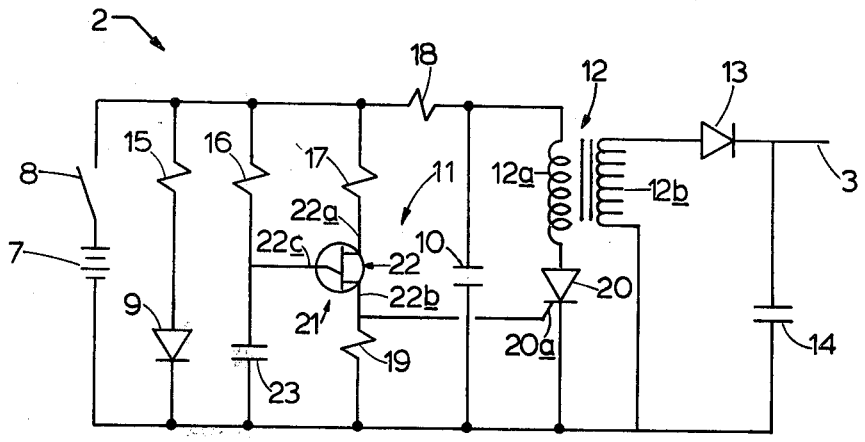
FIG. 3 is a circuit diagram of the circuit of the device shown in FIGS. 1 and 2 in which the trigger means comprises an SCR and a unijunction transistor.

The device shown in FIGS. 1 to 3 of the accompanying drawings comprises a casing 1 housing a circuit 2 for producing a positive pulse charge at a sharp tip discharge electrode 3 for discharging negatively charged articles such as records.

The casing 1 comprises two halves 1*a*, 1*b* moulded from a suitable electrically insulative plastic material and adhesively secured together. The discharge electrode 3 is located in a concave depression 4 in the end face 1*c* of the casing so that the tip of the electrode is below the end face 1*c*. A manually operable push button 5 and a transparent window 6 are located in the upper surface 1*d* of the casing.

The circuit 2 shown in FIG. 3 with conventional symbols comprises battery means 7, a switch 8, a light emitting diode (LED) 9, a capacitor 10, trigger means 11, a transformer 12, a diode 13, a smoothing capacitor 14, the discharge electrode 3 and various protective resistors 15, 16, 17, 18 and 19 connected as shown.

The trigger means 11 comprises an SCR 20 and firing means 21 for the SCR. The firing means 21 includes a unijunction transistor 22, a capacitor 23 and the resistors 16, 17 and 18. The base two electrode 22*a* of the transistor is connected to the positive terminal of the battery means 7, the base-one electrode 22*b* is connected to the gate electrode 20*a* of the SCR and the emitter electrode 22*c* is connected to the capacitor 23 and the resistor 16. Connected in this way the unijunction transistor 22 functions as a relaxation oscillator.

The voltage across the SCR 20 when triggered in this circuit is approximately 18 volts and the transformer 12 is therefore provided with a greater number of turns in the secondary winding 12*b* than in the primary winding 12*a* so that induced voltage in the secondary winding is stepped up relative to the discharge voltage of the capacitor.

In use when the button 5 is depressed the switch 8 is closed, the capacitor 10 is charged and the SCR 20 is non-conducting. Simultaneously, the capacitor 23 is charged through resistor 16 until the emitter voltage reaches the emitter peak point voltage at which time the unijunction transistor 22 turns on and discharges capacitor 23 through resistor 18 and produces a pulse at the gate electrode 20*a* of the SCR to fire the SCR which becomes conducting. The capacitor 10 then discharges through the primary winding 12*a* of the transformer and a larger induced voltage is produced in the secondary winding 12*b* which is rectified by the diode 13 to produce a positive pulse charge at the discharge electrode 3. The positive charge on the electrode 3 charges the surrounding air negatively which induces a positive charge on any article close to the electrode and the induced positive charge discharges any negative charge on the article.

If the button 4 is held down thus keeping the switch 8 closed, automatic and periodic operation occurs resulting in a series of positive pulse charges being produced which are converted by the smoothing condenser 14 connected across the output from the diode 13 to a smoothed or semi-smoothed positive D.C. potential at the electrode 3.

It has been found that the device operates more effectively with a consistent positive potential at the discharge electrode as this causes better ionization of the surrounding air than a series of separate pulse charges.

A visual indication that the device is operating is provided by the LED 9 which is arranged so as to be visible through the window 6 in the upper surface 1*d* of the body.

The firing means of the above-described circuit may comprise a PUT, a silicon unilateral switch or a silicon control switch all of which are used as relaxation oscillators. Alternatively the firing means may comprise a resistance-capacitance circuit.

Figure 4:
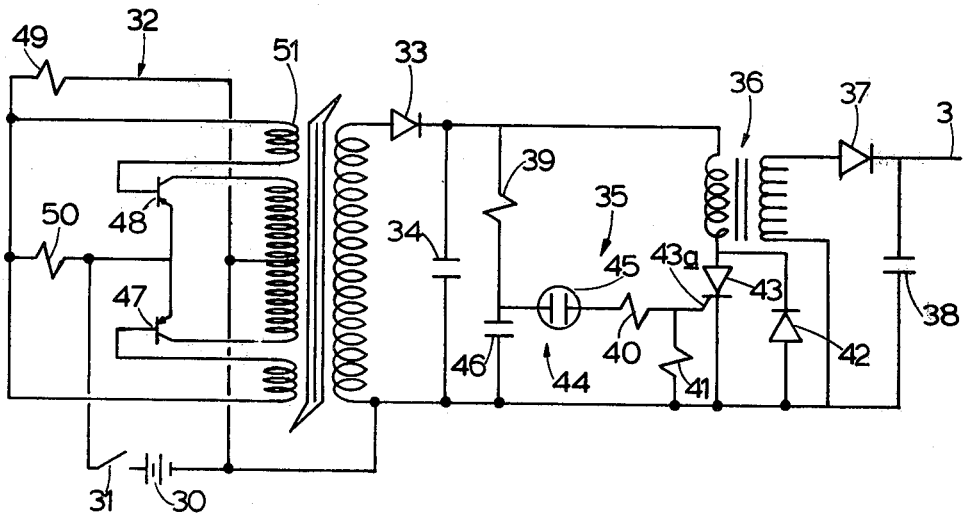
FIG. 4 is a circuit diagram of an alternative circuit in which the trigger means comprises an SCR and a neon tube.

FIG. 4 shows a second circuit 2 which using conventional symbols comprises battery means 30, a switch 31, inverter means 32, a rectifier 33, a capacitor 34, trigger means 35, a transformer 36, a diode 37, a smoothing capacitor 38 the discharge electrode 3, various protective resistors 39, 40, 41, and a protective diode 42 connected as shown.

The trigger means 35 comprises an SCR 43 and firing means 44 for the SCR. The firing means 44 includes a neon lamp 45 and a capacitor 46. One electrode of the neon lamp is connected to the capacitor 46 and the other electrode is connected to the gate electrode 43*a* of the SCR.

The voltage across the SCR when triggered in this circuit is considerably greater than the 18 volts required to trigger the SCR in the circuit of FIG. 3 and the inverter means 32 provides the necessary stepping up of the voltage obtained from the battery means 30.

The inverter means 32 is of known type for amplifying and inverting a D.C. input voltage to produce an amplified A.C. output and comprises a pair of transistors 47,48 a pair of resistors 49, 50 and a transformer 51. Amplified A.C. output is rectified by the rectifier 33 to produce a D.C. voltage.

In use when the button 5 is depressed the switch 31 is closed, the capacitors 34 and 51 are both charged by the amplified D.C. voltage produced by the inverter 32 and rectifier 33. At a predetermined voltage level, the neon ionises and the neon lamp 45 becomes conductive. The capacitor 46 discharges through the neon lamp 45 and produces a pulse at the gate electrode 43*a* of the SCR to fire the SCR which becomes conducting whereupon the capacitor 34 discharges through the primary winding of the transformer 36 inducing a voltage in the secondary winding. The high voltage diode 37 rectifies the induced voltage to produce a positive pulse charge at the discharge electrode 3 which can be used to discharge negative static electricity on an article as previously described.

The diode 42 connected between the anode and cathode of the SCR 43 protects the SCR and prevents it from being fired as a result of coil oscillations produced when the capacitor 34 discharges through the primary winding 36*a* of the transformer.

The smoothing capacitor 38 connected across the output from the diode 37 ensures a consistent D.C. potential is produced at the electrode 3 when the device is operated continuously.

An LED or similar means may be provided to give a visual indication of when the device is operating. Furthermore the inverter means may be replaced by a ringing choke which is simpler and cheaper to make since it requires fewer associated components.

Figure 5:
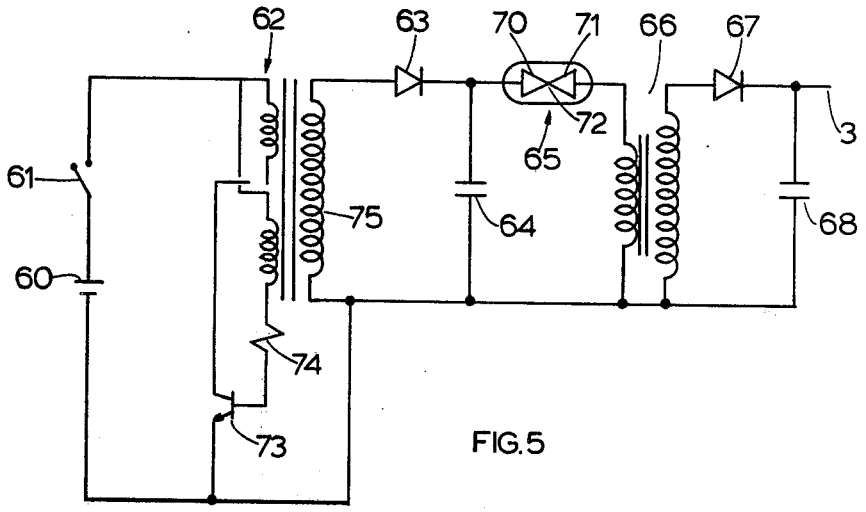
FIG. 5 is a circuit diagram of a third circuit in which the trigger means comprises a pair of electrodes defining a spark gap.

FIG. 5 shows a third circuit which using conventional symbols comprises battery means 60, a switch 61, inverter means comprising a ringing choke 62, a rectifier 63, a capacitor 64, trigger means 65, a transformer 66, a diode 67, a smoothing capacitor 68 and the discharge electrode 3 connected as shown.

The trigger means 65 comprises a pair of electrodes 70, 71 defining a spark gap 72. The electrodes are sealed in a glass tube filled with a rare gas and are arranged so that a spark passes between them at a relatively high voltage, approximately 210 volts.

The ringing choke 62 is of known type for amplifying and inverting a D.C. input voltage to produce an A.C. output and comprises a transistor 73 a resistor 74 and a transformer 75. Amplified A.C. output is rectified by the rectifier 63 to produce a D.C. voltage.

In use when the button 5 is depressed the switch 61 is closed and the capacitor 64 is charged until the voltage reaches the value required to cause a breakdown across the spark gap electrodes 70, 71. The energy stored in the capacitor 64 is then transferred across the spark gap 72, seen as a spark, and discharged through the primary winding of the transformer 66 inducing a high voltage in the secondary winding. The high voltage diode 67 rectifies the induced voltage to produce a positive pulse charge at the electrode 3 which can be used to discharge negative static electricity on an article as previously described.

The smoothing capacitor 68 connected across the output from the diode 67 ensures a consistent D.C. potential is produced at the electrode when the device is operated continuously. The rate at which pulses are produced is approximately 37 per second but this may vary in the range from 25 to 50 pulses per second depending on various factors such as the frequency of oscillation of the pulses from the transformer 75, the capacitance value and the spark gap breakdown voltage.

The voltage generated at the electrode 3 is approximately 15 k volts but this may vary depending on various factors such as the frequency at which the pulses are generated, the amount of energy in each pulse which depends on the capacitance value and the spark gap breakdown voltage, the leakage across the smoothing capacitor 68 and the efficiency of the voltage transformer 66. In the above described embodiment the ratio of turns on the secondary winding to the primary winding of the transformer 66 is approximately 300:1.

A visual indication of when the device is operating is provided by the spark gap 72 which is arranged to be visible through the window 6 in the casing.

The ringing choke 62 of the above described circuit may be replaced by the inverter means described in connection with the circuit illustrated in FIG. 4.

It has been found that the device operates more effectively when the button 5 is made of electrically conductive material and is connected with either positive or negative terminals of the battery means of the above described circuits thereby giving the device a reference ground through the body of the operator. The button 5 is preferably made of electrically conductive plastic material but may be made of metal or metallised plastic material.

Figure 6:
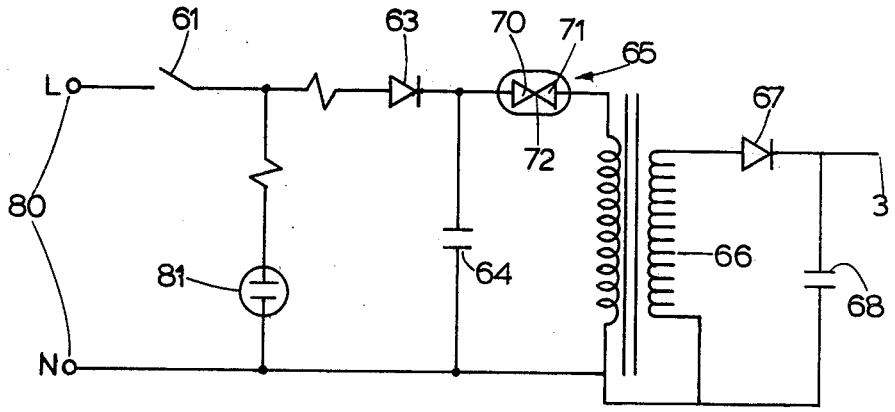
FIG. 6 shows a modification of the circuit shown in FIG. 5 in which the circuit is operable from the A.C. mains.

FIG. 6 shows a modification to the circuit shown in FIG. 5 in which the circuit is adapted for operation from the mains voltage as the power supply instead of the battery means. Like reference numerals are used to indicate similar parts.

The battery means 60 and ringing choke 62 of the circuit of FIG. 5 are replaced by a suitable input 80 for connection to the mains voltage and a neon lamp 81 is provided to give a visual indication when the switch 61 is closed and the circuit is operating. Operation of the circuit to produce a pulse charge at the electrode 3 is similar to that already described with reference to FIG. 5.

The circuit of FIG. 4 can also be modified in similar manner for operation from the mains voltage.

In each of the circuits described the diode connected to the discharge electrode is arranged to produce a positive pulse charge at the discharge electrode which discharges a negative charge on an article. However, in each of the circuits shown if the diode is reversed a negative pulse charge is produced at the discharge electrode which will discharge a positive charge on an article. Thus if the charge on the article to be discharged is known, i.e. positive or negative, the circuit can be modified accordingly.

The anti-static device can therefore have a number of uses and is not limited to discharging static electricity on records. For example, when the charge of the article is known a suitable device could be used for discharging static on fibres, papers used for electrostatic photocopying machines, labelling of plastic bottles and the application of paint and transfers to plastic car bodies.

I claim:

1. A manually operable portable device for discharging static on articles, said device comprising a casing for holding in a user's hand, a manually operable actuator mounted in said casing for operation by the user, power supply means connected to switch means operable by said actuator with said actuator being made of electrically conductive material and connected to said power supply means for giving said device a reference ground, a capacitor connected to said power supply means for charging thereby, a transformer of which the primary winding is connected to said capacitor and the secondary winding is connected to a discharge electrode, trigger means connected to said capacitor to trigger said capacitor when the charge stored by said capacitor reaches a predetermined level, and rectifier means connected between said secondary winding of said transformer and said discharge electrode whereby a pulse charge of given polarity is generated at said discharge electrode when said capacitor discharges through said primary winding of said transformer.

2. A device according to claim 1 including a smoothing capacitor connected across the output from said rectifier means.

3. A device according to claim 1 wherein said trigger means comprises an SCR and firing means for said SCR.

4. A device according to claim 3 wherein said firing means comprises a relaxation oscillator and a capacitor.

5. A device according to claim 4 wherein said relaxation oscillator comprises a unijunction transistor.

6. A device according to claim 1 wherein said casing includes a transparent window and said trigger means comprises a pair of electrodes defining a spark gap aligned behind said window and within said casing whereby sparking across said gap gives a visual and audible signal in the use of said device.

* * * * *